US007905523B2

(12) United States Patent
Stefanic et al.

(10) Patent No.: US 7,905,523 B2
(45) Date of Patent: Mar. 15, 2011

(54) MOTOR VEHICLE LOCK

(75) Inventors: Josip Stefanic, Odenthal (DE); Checrallah Kachouh, Dortmund (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 724 days.

(21) Appl. No.: 10/998,147

(22) Filed: Nov. 29, 2004

(65) Prior Publication Data

US 2005/0134054 A1 Jun. 23, 2005

(30) Foreign Application Priority Data

Nov. 28, 2003 (DE) ..... 103 56 306

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/28, 30, 50, 53, 95, 96, 194, 195, 216, 292/235, 237, DIG. 23, DIG. 36
See application file for complete search history.

(56) References Cited

U.S. PATENT DOCUMENTS

| | | | | |
|---|---|---|---|---|
| 3,177,022 | A * | 4/1965 | McKee et al. | 292/50 |
| 3,258,062 | A * | 6/1966 | Lambert | 160/201 |
| 4,575,138 | A * | 3/1986 | Nakamura et al. | 292/216 |
| 4,836,591 | A * | 6/1989 | Faust | 292/336.3 |
| 4,848,809 | A * | 7/1989 | Escaravage | 292/11 |
| 4,906,035 | A * | 3/1990 | Nagai et al. | 292/201 |
| 4,951,979 | A * | 8/1990 | Escaravage | 292/110 |
| 4,974,885 | A * | 12/1990 | Yokoyama | 292/201 |
| 4,998,049 | A | 3/1991 | Chapman | |
| 5,516,164 | A | 5/1996 | Kobayashi | |
| 5,549,337 | A * | 8/1996 | McCulloch | 292/225 |
| 5,560,658 | A * | 10/1996 | Coolman et al. | 292/28 |
| 5,934,717 | A | 8/1999 | Wirths et al. | |
| 6,135,514 | A | 10/2000 | Kowalewski et al. | |
| 6,279,972 | B1 * | 8/2001 | Brill et al. | 292/216 |
| 6,485,068 | B1 * | 11/2002 | Sauve | 292/171 |
| 6,540,269 | B2 * | 4/2003 | Wurges et al. | 292/125 |
| 6,805,386 | B2 * | 10/2004 | Ehret et al. | 292/216 |
| 6,942,260 | B2 * | 9/2005 | Bucker et al. | 292/336.3 |
| 6,948,746 | B2 * | 9/2005 | Brammall et al. | 292/315 |
| 2007/0138802 | A1 * | 6/2007 | Stasko et al. | 292/201 |

FOREIGN PATENT DOCUMENTS

| | | |
|---|---|---|
| DE | 2 001 653 | 7/1971 |
| DE | 196 04 724 A1 | 8/1997 |
| DE | 101 11 085 A1 | 9/2002 |
| DE | 102 00 551 A1 | 7/2003 |
| EP | 0 103 904 A2 | 3/1984 |
| WO | 03/046321 A1 | 6/2003 |

* cited by examiner

*Primary Examiner* — Carlos Lugo
(74) *Attorney, Agent, or Firm* — Roberts Mlotkowski Safran & Cole, P.C.; David S. Safran

(57) ABSTRACT

A motor vehicle lock with a latch and an associated ratchet and a motor for opening the ratchet. The motor vehicle lock has a flexible traction device which directly or indirectly connects the motor to the ratchet and which is wound up by the motor for opening the ratchet and which can be unwound by spring force when the motor is turned off.

39 Claims, 8 Drawing Sheets

MOTOR VEHICLE LOCK

BACKGROUND OF THE INVENTION

1. Field of the Invention

The present invention relates to a motor vehicle lock and, more specifically, to the use of a motor to open the ratchet of a motor vehicle lock.

2. Description of Related Art

A vehicle lock which is known, for example, from published German Patent Application DE 196 14 122 A1, (corresponding to U.S. Pat. No. 5,934,717), and which is popular for motor vehicle side doors, has a latch and an assigned hook-shaped ratchet. The latch can hold or secure a striker and is, for its part, blocked by the ratchet which can engage the latch in a main catch position and a preliminary catch position.

Published German Patent Application DE 20 01 653 A shows a motor vehicle lock with a latch and an assigned (i.e., associated) ratchet. The ratchet is not hook-shaped, but instead made in the manner of a swiveling pin. The pin has a recess that forms an engagement section which can be moved into blocking engagement with the latch by swiveling the pin. The actuation of the ratchet, which has been formed in this way, takes place via a conventional lever arrangement.

Published German Patent Application DE 101 11 085 A1 discloses a motor vehicle lock with a latch and a ratchet, which can be actuated, for example, by an electric motor via a worm gear. This gear requires high precision of all components and therefore high production costs. In practice, it has been shown that a worm gear tends to premature failure. Another disadvantage is that a worm gear transfers the motor noise to all other components so that the motor vehicle lock exhibits undesirably high operating noise.

Published German Patent Application DE 196 04 724 A1 discloses a motor vehicle lock with a latch and an assigned ratchet. A flexible traction element called a cable pull connects the ratchet to the handle so that the ratchet can be opened by manual actuation of the handle. As such, there is no motorized driving of the ratchet.

Published German Patent Application DE 102 00 551 A1 discloses a motor vehicle lock with a swiveling catch that is used to directly secure or hold the striker in an inlet slot of the motor vehicle lock in a locked or blocked state. The catch can be swiveled manually, or by motor, via an opening element in the opening direction. The opening element can have a sheathed cable. Specific instructions for implementation of an opening drive by means of a flexible traction means are not provided.

SUMMARY OF THE INVENTION

An object of the present invention is directed to a motor vehicle lock and the use of a motor for opening the ratchet of a motor vehicle lock so that a simple and economical structure, with few components and/or simple triggering is enabled, and a durable structure which is subject only to little wear can be implemented with little operating noise.

The present invention provides a flexible traction means, especially a cable or belt, which can be wound up preferably directly by the motor or the driven shaft of the motor and which acts directly or indirectly on the ratchet. In particular, the ratchet can be opened against a spring force by the traction means. This enables a simple and economical structure, since only a few components and no especially precision-manufactured components are necessary. Another advantage of the present invention resides in the fact that the operating noise of the motor is not transferred by the traction means or is transferred only to a small degree to the other parts. Another advantage resides in the fact that that precision gear engagement, as in a worm gear, is not necessary, so that wear problems in this respect can be avoided. Finally, with the use of the aforementioned traction means for drive engineering purposes, invulnerability to fouling is ensured. Moreover, the greasing which is necessary in toothed gearing is completely eliminated.

Another advantage of the present invention, is that low self-locking can be accomplished. After the motor is turned off, the traction means can be automatically unwound again by spring force and, thus, the ratchet can be swiveled to be able to move back into its blocking position. Preferably, the reset force is produced by a spring which is present anyway and for example is assigned to the ratchet or a rocker arm or the like which is coupled to the ratchet. In this way, both a simple and thus economical structure and also simple triggering are enabled.

Preferably, on the ratchet or the assigned rocker arm, there is a deflection roller for the traction means and the free end of the traction means is thrust for example against the housing of the motor vehicle lock. Thus speed transformation is easily achieved, and by the corresponding choice of the geometrical ratios and arrangements a transmission ratio which is adapted to need can be implemented.

An especially durable arrangement arises by the connection, which has been formed by the traction means, between the motor and the ratchet (a direct connection without an interposed deflection lever). Matching of the speed transformation can be achieved by the fundamentally present possibility of variation of the diameter of the driven shaft.

Outfitting the ratchet, with an essentially cylindrical section, with the traction means, attached to its jacket surface, leads to an especially compact and economical version. The traction means is then wound and unwound to a certain extent over a certain angle range when the ratchet is moved. The angle range is preferably distinctly less than 180°.

Other advantages, features, properties and aspects of this invention derive from the following description of preferred embodiments.

DETAILED DESCRIPTION OF THE INVENTION

In the figures the same reference numbers are used for the same or similar parts, the corresponding or comparable properties and advantages being achieved even if a repeated description is omitted.

Figure 1:
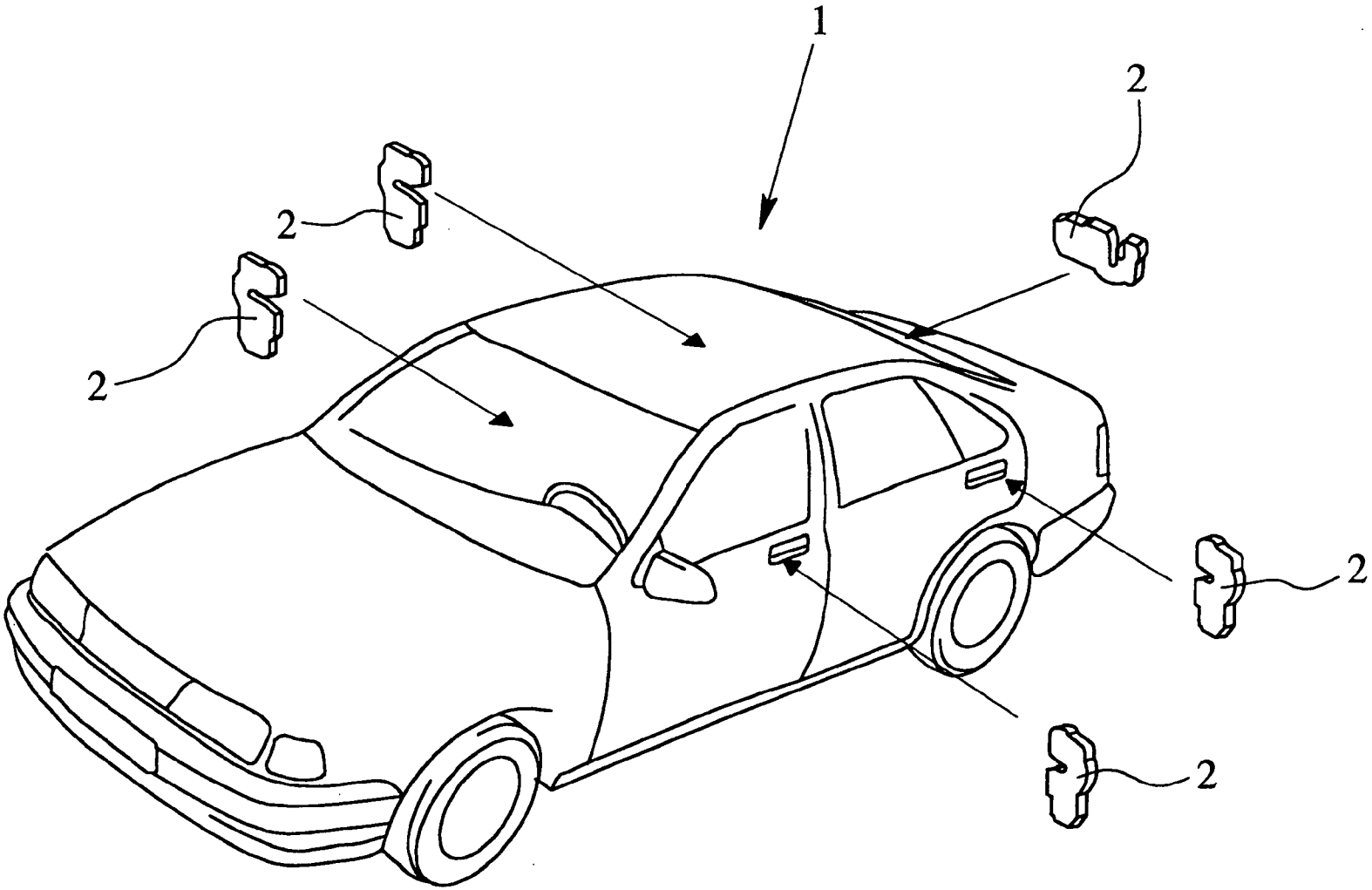
FIG. 1 shows a schematic perspective view of a motor vehicle with several motor vehicle locks.

FIG. 1 schematically shows a motor vehicle 1 with several motor vehicle locks 2, such as side door locks, a hood lock, and the like. The arrows in FIG. 1 indicate the approximate installation position of the illustrated motor vehicle locks 2 in the motor vehicle 1. The term "motor vehicle lock" is defined primarily as the door lock of a motor vehicle. But it can also be a trunk lock, a hood lock, a hatch lock or the like of a motor vehicle. The structure of a motor vehicle lock 2 of the present invention is detailed below.

Figure 2:
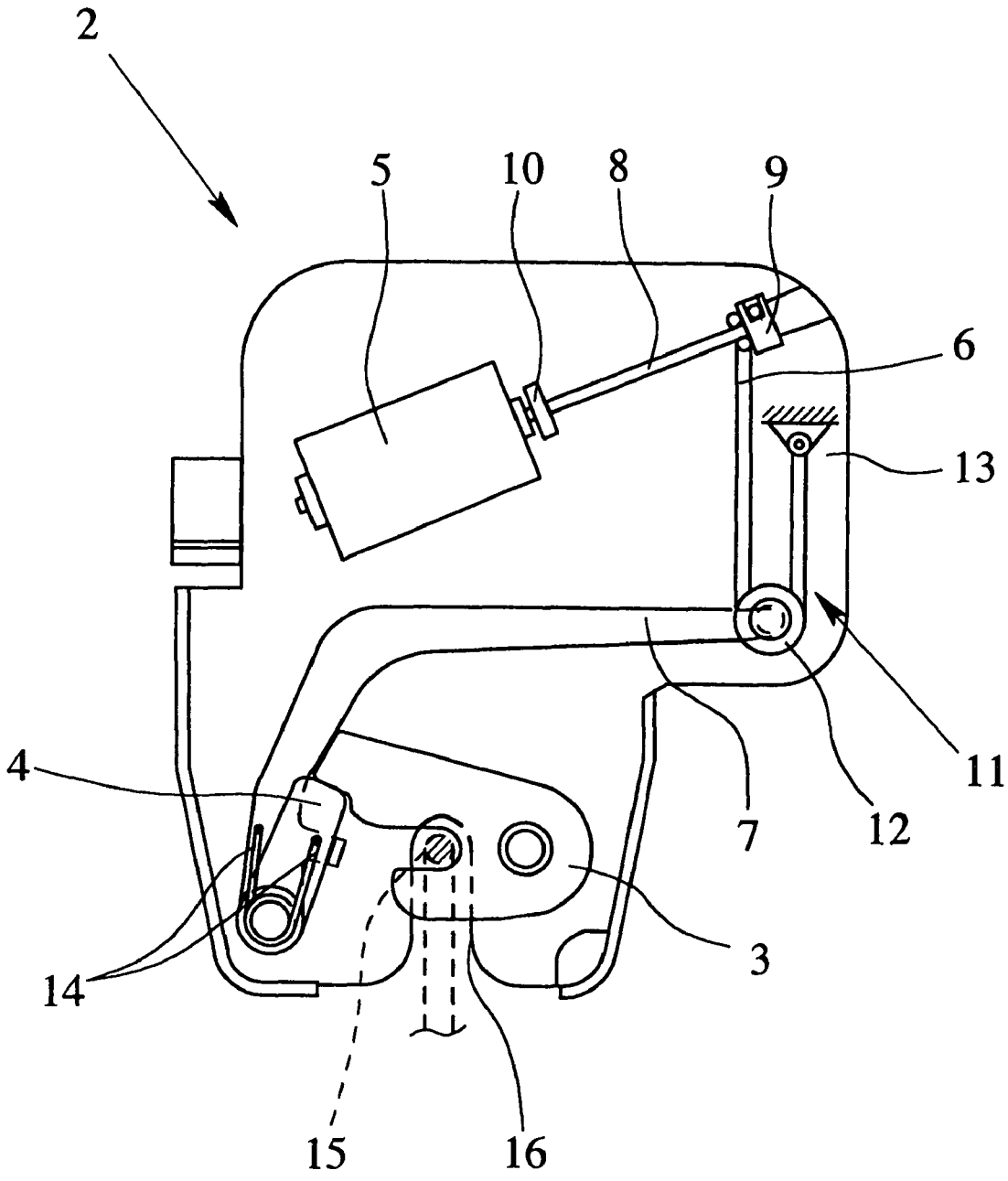
FIG. 2 shows a schematic view of the motor vehicle lock of the invention in the locked state.

FIG. 2 schematically shows one exemplary embodiment of a motor vehicle lock 2 shown in a locked state. The motor vehicle lock 2 has a latch 3 which is a rotary latch, an assigned ratchet 4 and a motor 5 for opening the ratchet 4. The ratchet 4 can secure the latch 3, preferably in a main catch position and a preliminary catch position, as is conventional in most motor vehicle door locks, hereinafter called the blocked position, and thus can lock the motor vehicle lock 2. The ratchet 4 can be moved (e.g., swiveled) into a non-engagement position, out of the blocked position in which the ratchet 4 is engaged with the latch 3, or can engage it. This is hereinafter called opening or the open position, of the ratchet 4.

In accordance with this exemplary embodiment, the motor 5 is, for example, an electric motor. However, it can also be any other suitable drive. The motor vehicle lock 2 has a flexible traction means 6 so that the motor 5 can actuate, (especially open) the ratchet 4 by the traction means 6.

According to an exemplary embodiment of the present invention, the traction means 6 can act directly on the ratchet 4. This is explained in detail in conjunction with the embodiments shown in FIGS. 6 to 8. In the embodiment shown in FIG. 2, however, the traction means 6 acts indirectly on the ratchet 4, via a rocker arm 7 which is assigned to the ratchet 4.

The traction means 6 is preferably made as a cable, belt or chain. Structurally, the traction means 6 has a round or flat cross section, and can be made selectively in one piece or with several members. The traction means 6 can be formed from several preferably stranded filaments or strands. In this embodiment the traction means 6 is a cable. Moreover, the traction means 6 is preferably made of plastic and/or steel. According to another exemplary embodiment, the traction means 6 is a flat plastic or a steel belt.

The traction means 6 can be wound up by the motor 5, preferably gearlessly, directly onto the driven shaft 8 of the motor 5. To do this, the traction means 6 is connected, positively or nonpositively, to the driven shaft 8 at one end. Preferably, the traction means 6 is injected, or pressed for example, into a receiving part 9 which is permanently connected to the driven shaft 8, or is in some other manner, attached thereto. The receiving part 9 is preferably a flange and forms an axial stop for winding the traction means 6 onto the driven shaft 8.

The driven shaft 8 constitutes, for example, a shaft of the motor 5 which is made relatively long. But the driven shaft 8 can also be a lengthened or include an additional shaft segment. The additional shaft segment would be flanged to the actual motor shaft in the motor 5 or be directly connected to the actual motor shaft in some other way. If necessary, the driven shaft 8 can also be driven by the motor 5 via gearing (not shown). In this case, the gearing is preferably integrated into the motor 5 or flanged directly to it. As such, a geared motor is preferably employed.

The motor vehicle lock 2 can be made so that the traction means 6 is wound in a helical line (only in one layer) onto the driven shaft 8. To achieve this, the traction means 6, depending on the swivel position of the ratchet 4 or of the rocker arm 7 during the wind-up process, is accordingly laterally offset or guided. Thus, minimum wear of the traction means 6 and precision, repeatable actuating behavior of the drive train which has been formed, are enabled (see FIGS. 2 and 3).

Preferably, on the driven shaft 8, a winding stop 10 is spaced apart from the receiving part 9 so that, between the receiving part 9 and the winding stop 10, the traction means 6 can be wound onto the driven shaft 8. In particular, the winding stop 10 is, in accordance with one embodiment of the invention, a flange. Thus, reliable guidance of the traction means 6 on the driven shaft 8 is provided.

Preferably, the traction means 6 forms a cable pull 11. For this purpose, the traction means 6 is guided around a deflection roller 12 which is used as a "loose roller" on the ratchet 4 or, as in the embodiment shown in FIGS. 2 and 3, on the rocker arm 7. With its other or free end, the traction means 6 is thrust against the motor vehicle lock 2 or its housing 13. Preferably, the traction means 6 is suspended or pressed on the housing 13, especially on a correspondingly made bearing block or the like, in order to enable simple installation. However, the traction means 6 can, if necessary, also be injected with one end area, for example, or can be connected in some other way to the housing 13.

Depending on the geometrical arrangement of the components to one another and depending on the direction of the traction means 6, which runs from the drive shaft 8 to the deflection roller 12 and from the deflection roller 12 to the housing 13, and on the direction of motion (here the direction of swiveling motion) of the rocker arm 7 (or of the ratchet 4) there is a gear reduction which can be adapted as desired and can be varied depending on the swivel position, with the opening motion.

In particular, the cable pull 11 proceeding from the blocked position first forms relatively large gear reduction of the motor motion in order to be able to apply a large opening force or lifting force to the ratchet 4, which is optionally heavily loaded by the latch 3, and/or in order to overcome the abrasion forces. As opening progresses further, the gear reduction ratio decreases in order to enable a relatively prompt opening of the ratchet 4.

The ratchet 4 is preferably pretensioned by spring force into the blocked position. The rocker arm 7 is likewise pretensioned into the position shown in FIG. 2. This allows the engagement or the blocking function of the ratchet 4, and the rocker arm 7 to be pretensioned, independently of the pivot position of the ratchet 4, into the position by spring force.

Figure 3:
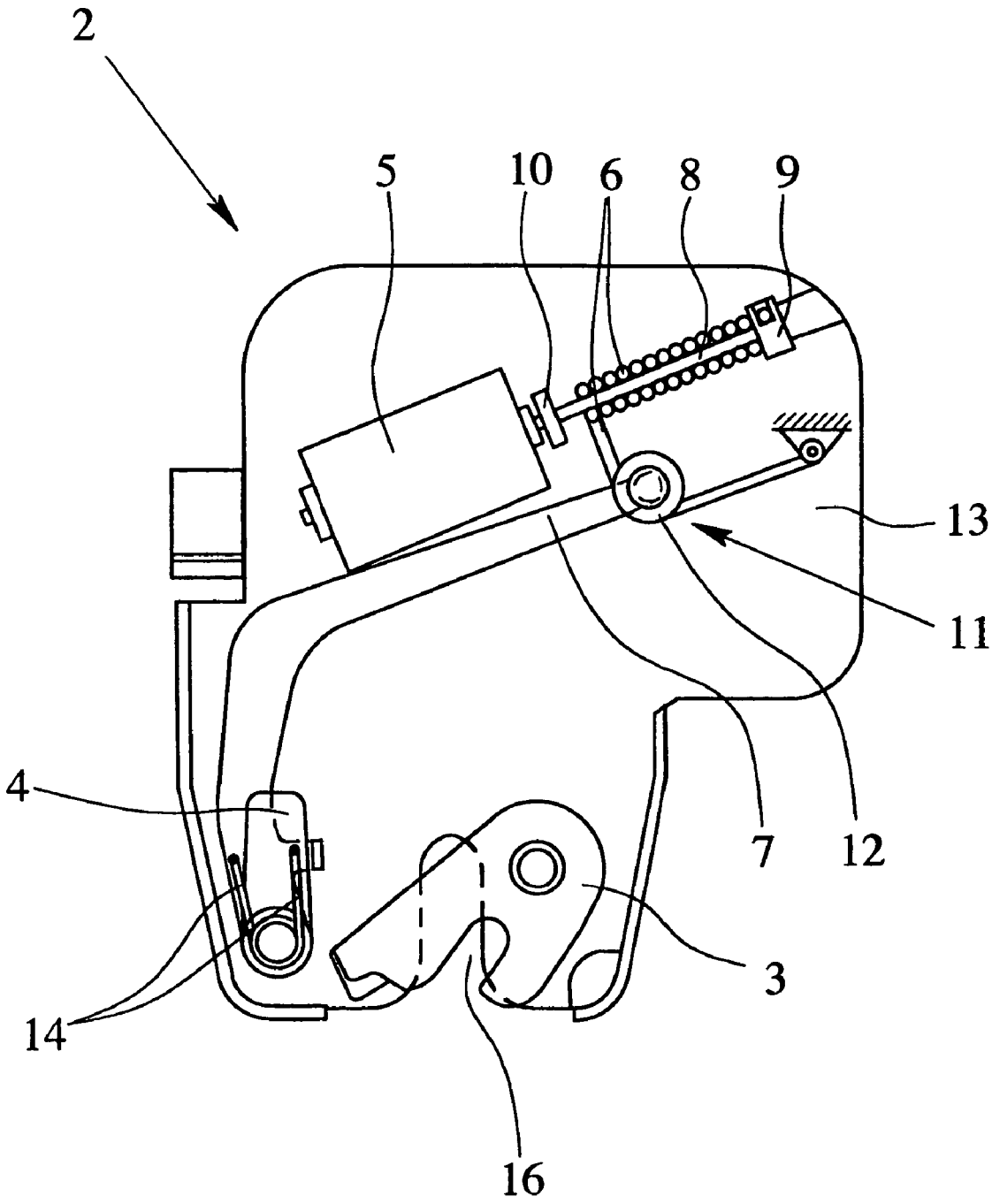
FIG. 3 shows a schematic of the motor vehicle lock of the invention as shown in FIG. 2 in the unlocked or opened state.

The ratchet 4 and the rocker arm 7 can be pretensioned in the indicated directions by two separate springs (not shown) or by a common spring 14 which is located on the swiveling axis of the ratchet 4 and/or of the rocker arm 7, as shown in FIGS. 2 and 3. Against the force of these springs 14, the traction means 6 can be wound up by the motor 5.

FIG. 3, in a representation which corresponds to FIG. 2, shows the motor vehicle lock 2 in the open state with the ratchet open and the rocker arm 7 open and with the traction means 6 wound. The pretensioning force acting on the ratchet 4 and/or the pretensioning force acting on the rocker arm 7 is or are preferably chosen and matched to the step-up or step-down ratio of the cable pull 11 as well as other mechanical influences such as the sluggishness of the motor 5. With the motor 5 turned off, the traction means 6, as a result of the indicated pretensioning force or forces, can be automatically unwound again from the driven shaft 8 so that the rocker arm 7 and/or the ratchet 4 is or are automatically reset again into the blocked position, or the position which allows the blocked position of the ratchet 4. In this way, a very simple structure and very simple triggering of the motor vehicle lock 2 are enabled.

FIG. 2 shows the motor vehicle lock 2 in the locked and closed state. The latch 3 holding or securing a striker 15 or the like in the inlet slot 16 is shown schematically. The latch 3 in this state for its part is blocked or secured against opening by the engaged ratchet 4.

The ratchet 4 can also be hook-shaped and can be used directly for securing the striker 15 or the like. The ratchet 4 can also have at least two hook sections, in order to imitate the conventional main catch position and the preliminary catch position of a conventional door lock with a latch.

Another embodiment of the motor vehicle lock 2 of the invention is explained below using FIG. 4. The only major differences from the first embodiment are explained below. Otherwise, the corresponding or comparable properties and advantages arise, the statements above applying accordingly. In the second embodiment, the traction means 6 is not guided around the deflection roller 12, but via a speed transformation wheel 17 to the ratchet 4 or, as in the embodiment, to its rocker arm 7.

The speed transformation wheel 17 is preferably made such that it reduces the winding-up motion of the motor 5 for the ratchet 4 or the rocker arm 7. The speed transformation wheel 17 constitutes gearing for the traction means 6. The speed transformation wheel 17 has a first motor-side wind-up area 18 and a second, driven-side wind-up area 19. The wind-up areas 18, 19 are preferably located at least essentially coaxially and are securely connected to one another. In particular, the speed transformation wheel 17 is made in one piece, preferably injected from plastic.

Figure 4:
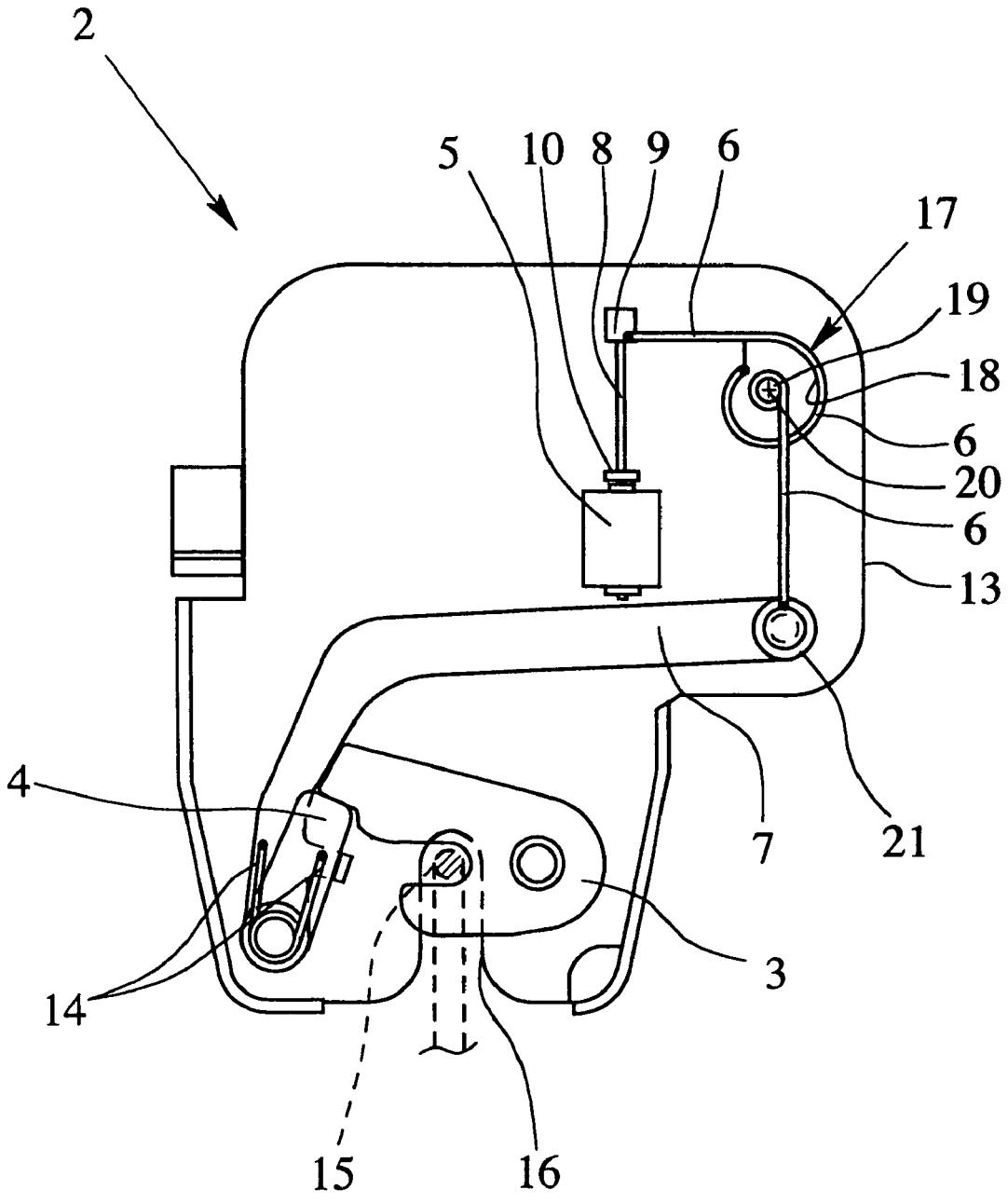
FIG. 4 shows a schematic of the motor vehicle lock of the invention according to a second embodiment in the locked state.

FIG. 4 shows the motor vehicle lock 2 in the locked state. When the motor 5 is turned on, the traction means 6 is wound directly onto the motor shaft 8 and, in doing so, is unwound from the first wind-up area 18, by which the speed transformation wheel 17 is turned. In this way, the drive-side part of the traction means 6 is wound onto the second wind-up area 19, by which the desired actuation of the ratchet 4 or of the rocker arm 7 is caused.

The radius of the first wind-up area 18 is larger than the radius of the second wind-up area 19, preferably at least by a factor of 2. In this way, a reduction of the motion of the traction means is achieved.

It is preferable for the effective winding radius of the first wind-up area 18 to vary. In the embodiment, the effective winding radius decreases when the speed transformation wheel 17 turns counterclockwise, yielding a worm-shaped or helical contour. This variation, especially the decrease or increase of the radius of the first wind-up area 18, is conducive to lateral guidance of the traction means 6 so that the traction means 6 is wound up on the motor shaft 8 only in a helical line or in one layer.

Additionally or alternatively, by varying the radius of the first wind-up area 18 and/or of the second wind-up area 19 gear reduction can be varied. Proceeding from the locked state, having significant gear reduction (to overcome large holding or adhesion forces) to a rapid opening or unlocking state, having increasingly smaller gear reduction, the gear reduction can be varied.

In contrast to the deflection roller 12, the speed transformation wheel 17, on the housing 13 of the motor vehicle lock 2, is pivotally supported. The axis of rotation 20 of the speed transformation wheel 17 runs preferably transversely, (e.g., perpendicularly) to the wind-up axle (the motor axle 8) and/or to the plane of motion or swiveling of the ratchet 4 or of the rocker arm 7.

Resetting (i.e., an unwinding of the traction means 6) of the motor shaft 8 takes place preferably by means of the spring 14 or by other spring forces after the motor 5 is turned off.

It is unnecessary for the first part of the traction means 6 (which extends as far as the first wind-up area 18) and the second part of the traction means 6 (which extends from the second wind-up area 19 to the rocker arm 7) to be identical. The first and second part of the traction means 6 can therefore be formed of different pieces and/or different material and/or can have different dimensions, (e.g., due to their different traction load).

However, preferably the two parts of the traction means 6 are produced from a single piece of the traction means, especially the cable piece. The traction means 6 which comprises the indicated first and second part is preferably made therefore in one piece. Accordingly, the traction means 6 is guided on or in the speed transformation wheel 17 from the first wind-up area 18 to the second wind-up area 19, as illustrated in FIG. 4.

The free end of the second part of the traction means 6 is preferably attached positively and/or by means of a lockable insert 21 to the ratchet 4 or, as in the embodiment, to the rocker arm 7. In particular, the insert 21 is molded directly onto the traction means 6.

Figure 5:
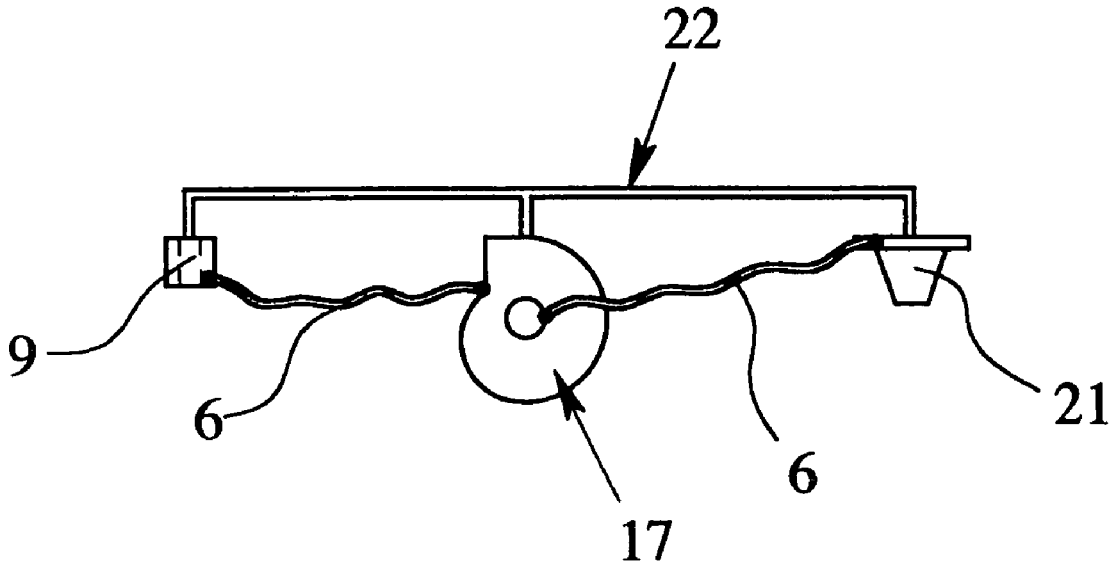
FIG. 5 shows an injection molding with the traction means for the motor vehicle lock as shown in FIG. 4.

The preferred manufacture is explained in detail as follows with respect to FIG. 5. Preferably, the traction means 6 is formed from a piece of material which is inserted directly into an injection mold so that, at the same time, the receiving part 9, the speed transformation wheel 17 and the insert 21 are molded onto the traction means 6 and are produced in doing so. At the same, time a positive connection between the traction means 6 and the components (i.e., the receiving part 9, the speed transformation wheel 17 and the insert 21) is produced. Optionally, the traction means 6 can be provided with a twist or the like, especially in the area of the speed transformation wheel 17 and/or in the area of its free ends, in order to ensure a reliable positive connection.

After their manufacture, the components are preferably first connected to one another via a connecting piece 22 such that the traction means 6 is, to some extent, held straight or taut. This facilitates support and handling until installation, since unwanted turning, tangling up, or binding of the traction means 6 is prevented. During installation then, the connecting piece 22 is released from the components. As a result, the receiving part 9, the speed transformation wheel 17 and the insert 21, and the traction means 6, together with the components, can be installed properly in the motor vehicle lock 2.

Since only one traction means piece is necessary, the production and installation cost is low since only the two ends of the traction means 6 need be cut off. Moreover, as FIG. 4 makes especially clear, a largely free arrangement of the axes of rotation is possible and, thus, overall the arrangement of the components is optional.

Figure 6:
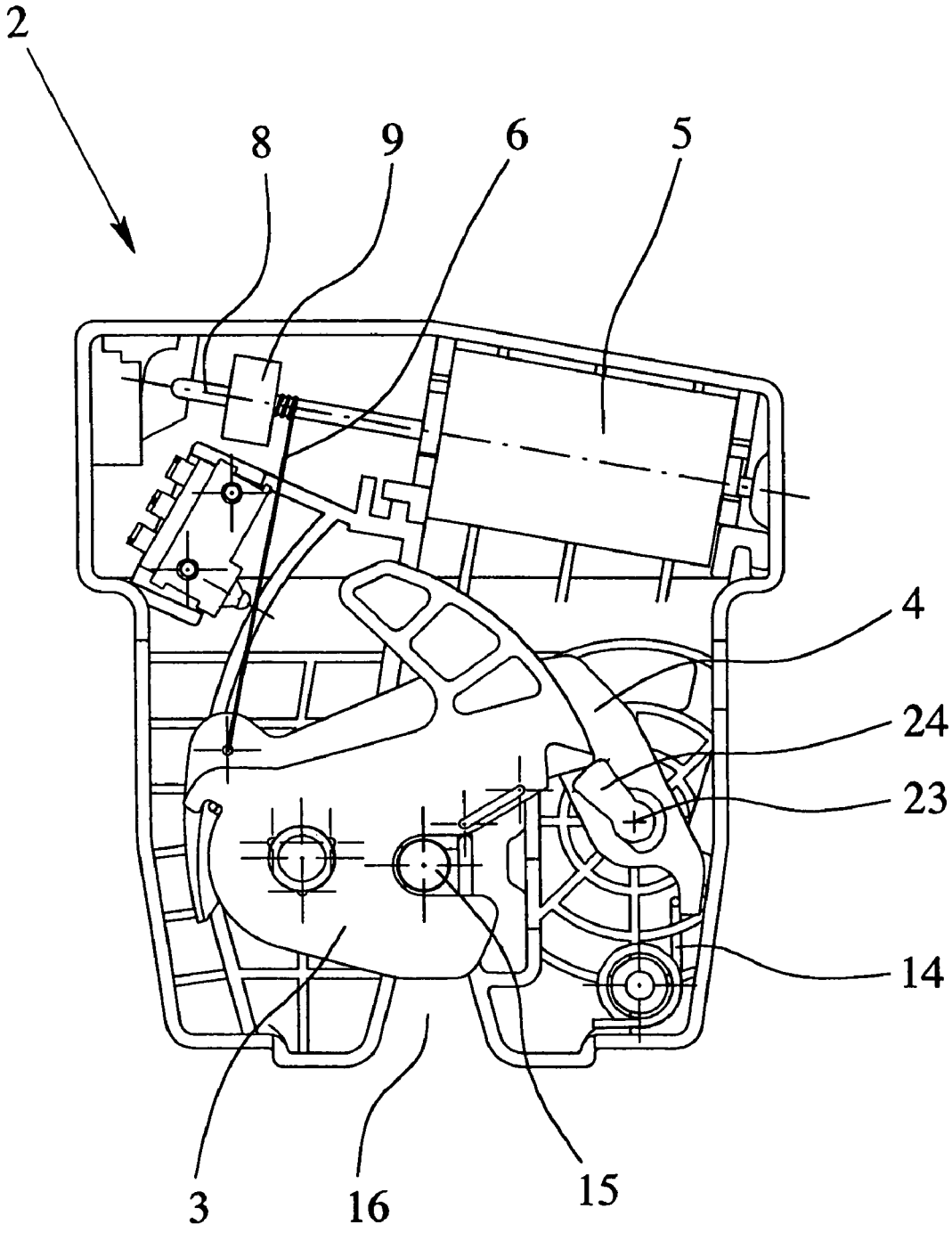
FIG. 6 shows a schematic of the motor vehicle lock of the invention according to a third embodiment in the locked state.
Figure 7:
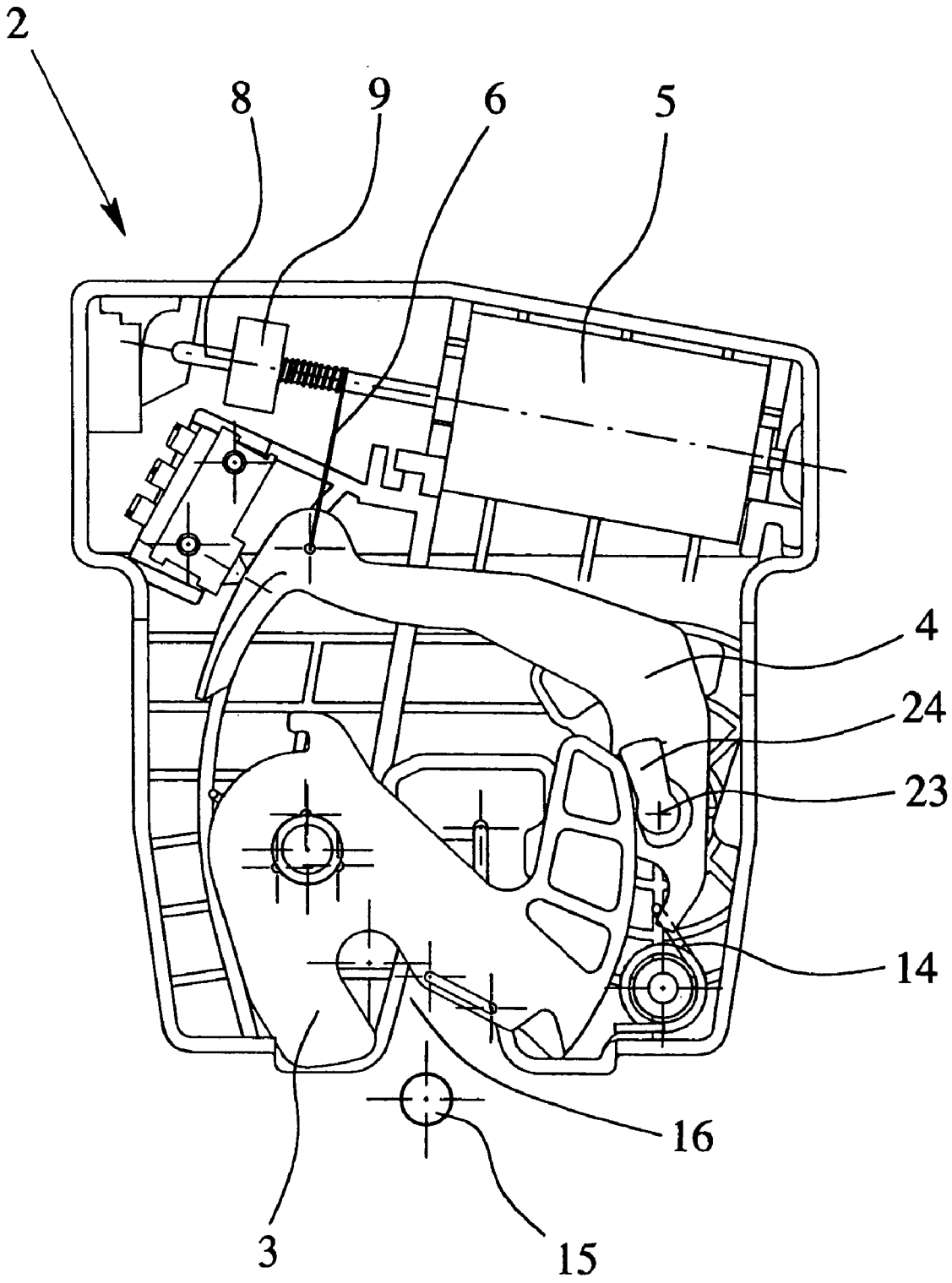
FIG. 7 shows a schematic of the motor vehicle lock of the invention as shown in FIG. 6 in the unlocked or opened state.

An especially durable embodiment of the motor vehicle lock 2 is shown in FIGS. 6 & 7. There is also the above described basic structure with the latch 3, ratchet 4 and the motor 5 here. There is use of a flexible traction means 6 in the above indicated manner here.

In the embodiment of the invention shown in FIGS. 6 and 7, it is important that the connection formed between the motor 5 and the ratchet 4, via the traction means 6 is a direct connection, without an interposed deflection means or the like. Thus, the traction means 6, coming from the driven shaft 8 of the motor 5, travels directly to the ratchet 4 and is attached to it. Proceeding from the locked state (shown in FIG. 6), actuation of the motor 5 causes helical winding of the traction means 6 on the driven shaft 8 of the motor 5 until the unlocked or opened state, or an optionally provided overstroke position, of the ratchet 4 is reached. The ratchet 4 is also pretensioned by a spring 14 in the blocking direction. The spring 14, in this embodiment, is a leg spring.

The ratchet 4 in all embodiments can be pivot around the ratchet axis 23. In the embodiment shown in FIGS. 6 & 7, the ratchet 4 is also equipped with an engagement element 24 which blocks the latch 3 in the locked state (shown in FIG. 6). It is especially advantageous that the engagement element 24 is located comparatively near the ratchet axis 23. In this way, the motor 5 can apply a comparatively small torque to the ratchet 4 to lift the latter.

It is advantageous if the engagement element 24 is located comparatively near the ratchet axis 23 and, at the same time, the point of application of the force of the traction means 6 is located on the ratchet 4 at a comparatively great distance from the ratchet axis 23. As a result, the drive force to be transferred via the traction means 6 is low.

Figure 8:
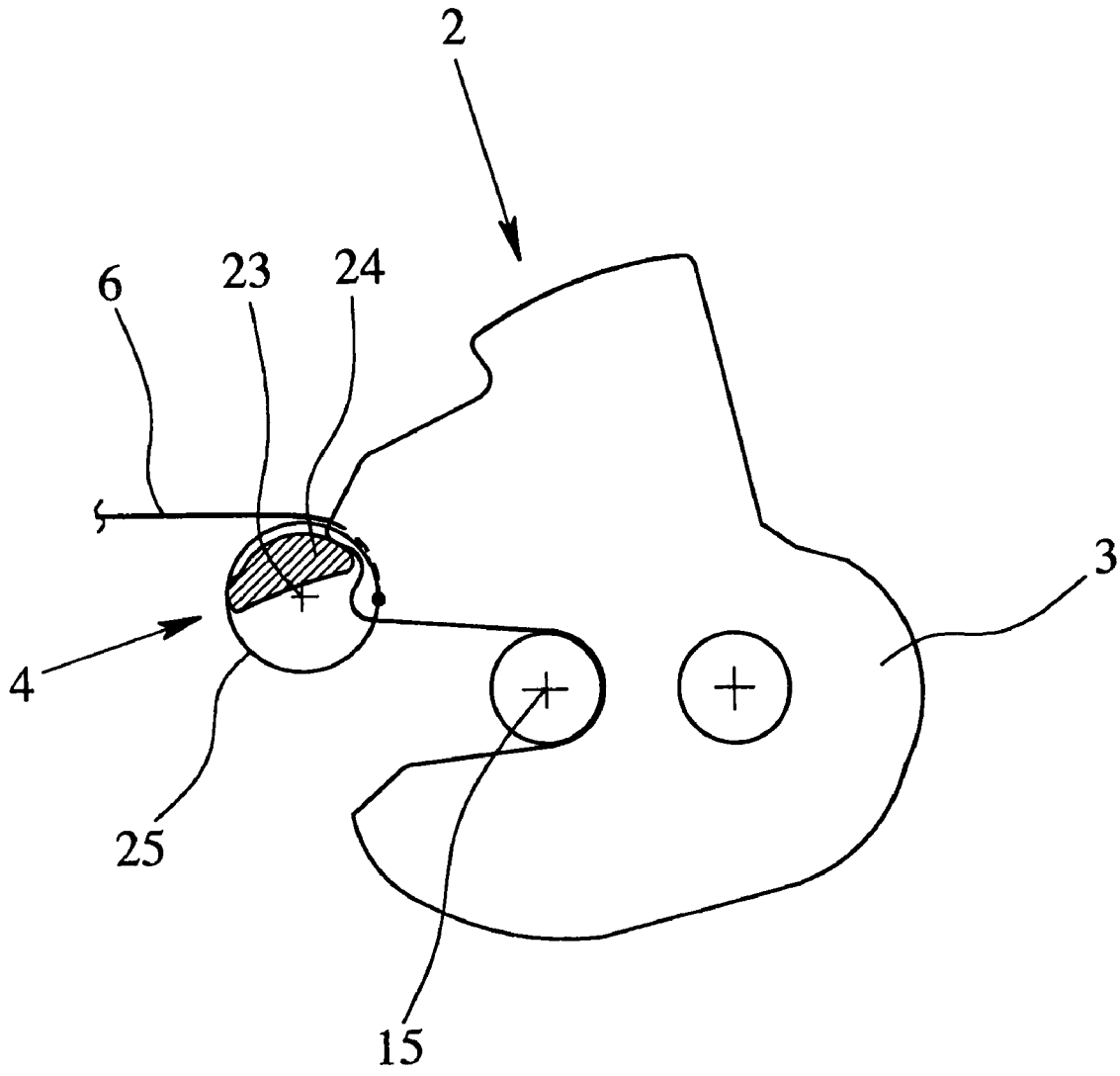
FIG. 8 shows a schematic extract of the motor vehicle lock of the invention according to a fourth embodiment in the locked state.

An especially compact arrangement is shown by the motor vehicle lock 2 shown in FIG. 8. The above described basic structure with the latch 3, ratchet 4 and motor 5 (not shown) is also implemented. Furthermore, there is also a flexible traction means 6 for opening the ratchet 4. The ratchet 4 can be pivoted around axis 23 and can be pretensioned by means of a spring (not shown) in the blocking direction (to the right in FIG. 8). The motor vehicle lock which is shown in FIG. 8 is in the locked state.

In the embodiment shown in FIG. 8, the ratchet 4 has an essentially cylindrical segment 25. The cylindrical segment 25 can be aligned centrally or eccentrically to the ratchet axis 23. The cylindrical segment 25 is aligned centrally to the ratchet axis 23. Note that the traction means 6 is attached to the jacket surface of the cylindrical segment 24 for connection of the motor 5 to the ratchet 4 and that it is deflected by the jacket surface. The arrangement is made such that pivoting of the ratchet 4 can be effected by the motor 5 via the traction means 6.

With respect to actuation of the ratchet 4, there need not be a lever or the like provided on the ratchet for connection of the traction means 6. The task of this lever is performed by the cylindrical segment 25 of the ratchet 4. In the central alignment of the cylindrical segment 25 to the ratchet axis 23, a constant drive force which has been transmitted via the traction means 6 causes a constant drive moment on the ratchet 4 over the entire range of movement of the ratchet 4. Conversely, the eccentric alignment of the cylindrical segment 25 to the ratchet axis 23 causes a speed transformation which changes with the motion of the ratchet 4. This can be advantageous, as described above. It should be pointed out that this ratchet 4 also has an engagement element 24 which is located comparatively near the ratchet axis 23. As described above, this leads to a comparatively small drive force required to be applied for actuation of the ratchet 4.

For the embodiment of the cylindrical segment 25 of the ratchet 4, a series of possibilities is conceivable. For example, the section can be narrow, just wide enough to ensure the corresponding winding or unwinding of the traction means 6 onto or off of the ratchet 4. But the cylindrical segment 25 can also extend essentially over the entire width of the ratchet 4.

In the two embodiments as shown in FIGS. 6, 7 and FIG. 8, respectively, the engagement section 24 projects out of the ratchet 4 (in FIGS. 6 to 8 out of the plane of the drawings). In this way, engagement between the engagement element 24 and the latch 3 is ensured.

Finally, the attachment of the traction means 6 to the housing 13, to the driven shaft 8 and to the receiving part 9 or to the ratchet 4 or the rocker arm 7 acquires special importance. Some possibilities in this respect have already been further explained above. In summary it should be pointed out that here all conceivable types of attachment can be used. Examples of this are suspension, binding, looping or clamping, and laser welding, cementing, extrusion coating or casting-in.

What is claimed is:

1. A motor vehicle lock comprising:

a latch and an associated ratchet;

a housing in which the ratchet and latch are mounted and which is adapted for mounting on a motor vehicle, the housing having an inlet opening for entry, in an installed state in motor vehicle, of a vehicle-mounted striker, a motor for opening the ratchet; and a flexible traction means which connects a shaft driven by the motor to the ratchet or a rocker arm associated with the ratchet and is windable by the motor onto the driven shaft for opening the ratchet to unlatch the lock, the flexible traction means being connected to the ratchet or the rocker arm associated with the ratchet in a manner causing helical winding of the traction means along the length of the shaft due to rotation of the shaft by the motor.

2. The motor vehicle lock as claimed in claim 1, wherein the traction means acts directly on the ratchet.

3. The motor vehicle lock as claimed in claim 1, wherein the traction means acts indirectly on the ratchet.

4. The motor vehicle lock as claimed in claim 1, wherein the traction means is one selected from the group consisting of a cable, a belt and a chain.

5. The motor vehicle lock as claimed in claim 1, wherein the traction means has a one of round and a flat cross section.

6. The motor vehicle lock as claimed in claim 1, wherein the traction means comprises a plurality of members.

7. The motor vehicle lock as claimed in claim 1, wherein the traction means is formed from several stranded filaments or strands.

8. The motor vehicle lock as claimed in claim 1, wherein the traction means is made of plastic or steel.

9. The motor vehicle lock as claimed in claim 1, wherein the traction means is windable by the motor without gearing.

10. The motor vehicle lock as claimed in claim 9, wherein the traction means is windable by the motor, directly onto a driven shaft of the motor.

11. The motor vehicle lock as claimed in claim 10, wherein the traction means is connected by one end to the driven shaft.

12. The motor vehicle lock as claimed in claim 10, wherein the connection formed between the motor and the ratchet by the traction means is a direct connection without an interposed deflection means.

13. The motor vehicle lock as claimed in claim 1, wherein the traction means is windable by the motor, directly onto a driven shaft of the motor.

14. The motor vehicle lock as claimed in claim 1, wherein the traction means is windable in a helical line and in a single layer.

15. The motor vehicle lock as claimed in claim 1, wherein the ratchet or the rocker arm, is pivotable, and the traction means is laterally guided depending on a pivot position of the ratchet.

16. The motor vehicle lock as claimed in claim 1, wherein a spring is provided that exerts a force counter to the traction means, the force of the spring acting on the ratchet, or a rocker arm associated with the ratchet, in a blocking direction.

17. The motor vehicle lock as claimed in claim 16, wherein the traction means is unwound automatically by the spring when the motor is turned off.

18. The motor vehicle lock as claimed in claim 1, wherein the traction means forms a block and tackle cable pull.

19. The motor vehicle lock as claimed in claim 1, wherein the motor vehicle lock has a deflection roller for the traction means to form a block and tackle cable pull.

20. The motor vehicle lock as claimed in claim 19, wherein the deflection roller is attached to the ratchet or to a rocker arm associated with the ratchet.

21. The motor vehicle lock as claimed in claim 1, wherein a free end of the traction means is positioned against the motor vehicle lock.

22. The motor vehicle lock as claimed in claim 1, wherein a free end of the traction means is suspended, injected or pressed on the housing of the motor vehicle lock.

23. The motor vehicle lock as claimed in claim 1, wherein the motor vehicle lock has a speed transformation wheel for the traction means, wherein the speed transformation wheel forms a gear reduction for a motor-side motion to the ratchet or a rocker arm associated with the ratchet.

24. The motor vehicle lock as claimed in claim 23, wherein the speed transformation wheel has a first wind-up area and a second wind-up area, and the radius of the first wind-up area is larger than the radius of the second wind-up area.

25. The motor vehicle lock as claimed in claim 24, wherein an effective radius of the first wind-up area varies depending on the rotary position of the speed transformation wheel.

26. The motor vehicle lock as claimed in claim 24, wherein the traction means is unwound from the first wind-up area by winding up the traction means from the motor, and, at the same time, the traction means which is connected to the ratchet or rocker arm is unwound onto the second wind-up area.

27. The motor vehicle lock as claimed in claim 23, wherein the speed transformation wheel is supported so as to be able to turn on the housing of the motor vehicle lock.

28. The motor vehicle lock as claimed in claim 23, wherein an axis of rotation of the speed transformation wheel runs transversely and perpendicularly to one of a wind-up axis, the drive shaft of the motor, a pivot plane of the ratchet and a pivot plane of the rocker arm.

29. The motor vehicle lock as claimed in claim 23, wherein the traction means is positively connected to the speed transformation wheel.

30. The motor vehicle lock as claimed in claim 23, wherein the traction means, proceeding from the speed transformation wheel is attached at one end to one of the ratchet and rocker arm by means of an insert which is attached to said one of the ratchet and rocker arm.

31. The motor vehicle lock as claimed in claim 30, wherein the insert is connected to the traction means by molding.

32. The motor vehicle lock as claimed in claim 23, wherein the speed transformation wheel is a single piece.

33. The motor vehicle lock as claimed in claim 1, wherein the connection formed between the motor and the ratchet by the traction means is a direct connection without an interposed deflection means.

34. The motor vehicle lock as claimed in claim 1, wherein the ratchet is pivotable around a ratchet axis, wherein the ratchet has a substantially cylindrical segment, wherein the cylindrical segment is aligned centrally or eccentrically relative to the ratchet axis, wherein the traction means for connecting the motor to the ratchet is attached to an outer surface of the cylindrical segment and is deflected by the outer surface so that the ratchet is pivotable by the motor via the traction means.

35. The motor vehicle lock as claimed in claim 1, wherein the ratchet is pivotable around a ratchet axis, wherein the ratchet has an engagement element that acts on the latch and that is located relatively near the pivot axis of the ratchet, and wherein said flexible traction means acts on the ratchet at a location that is relatively far from said pivot axis.

36. A method for operating a ratchet of a motor vehicle lock having a housing in which a ratchet and latch are mounted and which is adapted for mounting on a motor vehicle, the housing having an inlet opening for entry of a vehicle-mounted striker in an installed state in a motor vehicle, means acting on the ratchet for spring-loading it toward a blocking position preventing opening of the latch and being openable out of said blocking position by a flexible traction means, comprising the steps of:

operating the motor for winding the flexible traction means along the length of a shaft driven by the motor for moving the ratchet to an open position against the spring-loading acting on the ratchet, and resetting the ratchet into said blocking position by unwinding the flexible traction means via the spring-loading acting on the ratchet when the motor is turned off.

37. The method of claim 36, wherein the latch has a hook-shape and directly secures the striker of the motor vehicle lock in the inlet opening in the blocked state.

38. The method of claim 36, wherein the ratchet secures the latch of the motor vehicle lock with an engagement element that is located thereon relatively near a pivot axis of the ratchet, and wherein said flexible traction means acts on the ratchet at a location that is relatively far from said pivot axis.

39. A motor vehicle lock comprising:

a latch and an associated ratchet;

a housing in which the ratchet and latch are mounted and which is adapted for mounting on a motor vehicle, the housing having an inlet opening for entry, in an installed state in a motor vehicle, of a vehicle-mounted striker, a motor for opening the ratchet; and a flexible traction means which connects a shaft driven by the motor to the ratchet or a rocker arm associated with the ratchet, and is windable by the motor onto the shaft for opening the ratchet, wherein the ratchet or the rocker arm associated with the ratchet is mounted for pivoting movement in manner such that a point at which the traction means is attached thereto has a component of motion in a direction along the length of the shaft as the flexible traction means is wound on to the shaft.

* * * * *